US005345143A

United States Patent [19]

Little

[11] Patent Number: 5,345,143

[45] Date of Patent: Sep. 6, 1994

[54] LIGHT BULB WITH PROGRAM DISC

[76] Inventor: Charles T. Little, 20810 Avon La., Southfield, Mich. 48075

[21] Appl. No.: 937,139

[22] Filed: Aug. 31, 1992

[51] Int. Cl.[5] ..... H01J 7/44

[52] U.S. Cl. ..... 315/64; 315/65; 315/68; 315/70

[58] Field of Search ..... 315/64, 65, 67, 68, 315/66, 70; 313/493, 634

[56] References Cited

U.S. PATENT DOCUMENTS 3,886,400 5/1975 Dill ..... 315/64
4,121,134 10/1978 Fontonelle ..... 315/64
4,587,462 5/1986 Buhror ..... 313/493 X

*Primary Examiner*—Robert J. Pascal
*Assistant Examiner*—Haissa Philogene
*Attorney, Agent, or Firm*—John R. Benefiel

[57] ABSTRACT

A light bulb having a program disc interposed between a base and bulb components, the program disc having sockets on either side adapted to receive base and bulb pins. The program disc can be installed in various rotated positions to electrically connect one or more filaments in various ways to provide differing functions, such as successive filament energization, energizing combinations of filament or to supply varying power levels to a single filament.

8 Claims, 3 Drawing Sheets

LIGHT BULB WITH PROGRAM DISC

BACKGROUND OF THE INVENTION

The present invention concerns light bulbs particularly of the incandescent type having a single filament or multiple filaments adapted to be variably connected to a power source.

In U.S. Pat. No. 4,121,134 there is described an incandescent light bulb having multiple filaments and using a socket adapter threaded into a standard socket. The adapter has a spring contact connected to the voltage connection which is successively engagable with each of a series of side contacts on the bulb base. Each side contact is electrically connected with a respective filament so that each filament is successively energized as the bulb base is rotated in the adapter. This allows the bulb to be kept in service by merely rotating the bulb to a new position as each filament burns out.

However, the spring contacts are bulky and prone to failure.

Also, it would be desirable if other functional combinations of the power connections to a single or multiple filament bulb were possible, which are not enabled by the above-described arrangement.

Such other functional combinations include connecting more than one filament in a multiple filament bulb to create varying wattage or applying different voltages to a single filament bulb.

Accordingly, it is an object of the present invention to provide a compact and simple arrangement for providing varying electrical connections to a light bulb.

It is a further object to provide such an arrangement which enables functional combinations of the power connections to a single light bulb filament or to multiple light bulb filaments.

SUMMARY OF THE INVENTION

The present invention comprises an arrangement of a threaded base adapted to be screwed into a standard socket. The base carries an array of axial pins, including a pair of pins connected to the base so as to be energized when a voltage is applied to the socket when the light is turned on. A bulb component encloses one or more filaments each connected to projecting pairs of pins. An intermediate program disc is configured to mate with both sets of base and bulb pin pairs received in socket opening patterns disposed on opposite sides of the disc.

The disc has built in circuit connections associated with the sockets allowing programmed functional power combinations to the filament or filaments depending on the rotated position of the disc on the base.

The built in circuit leads may allow successive respective connection of the base power pins to each of a series of filaments included in the bulb for each of rotated positions of the program disc on the base.

Another arrangement of the built in circuit leads allows connection of the filaments together in various combinations to provide graduations in wattage outputs of the bulb for respective rotative positions of the disc on the base.

Still another arrangement allows various voltages to be applied to one or more filaments to allow varying power consumption levels depending on a selective rotated disc position.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
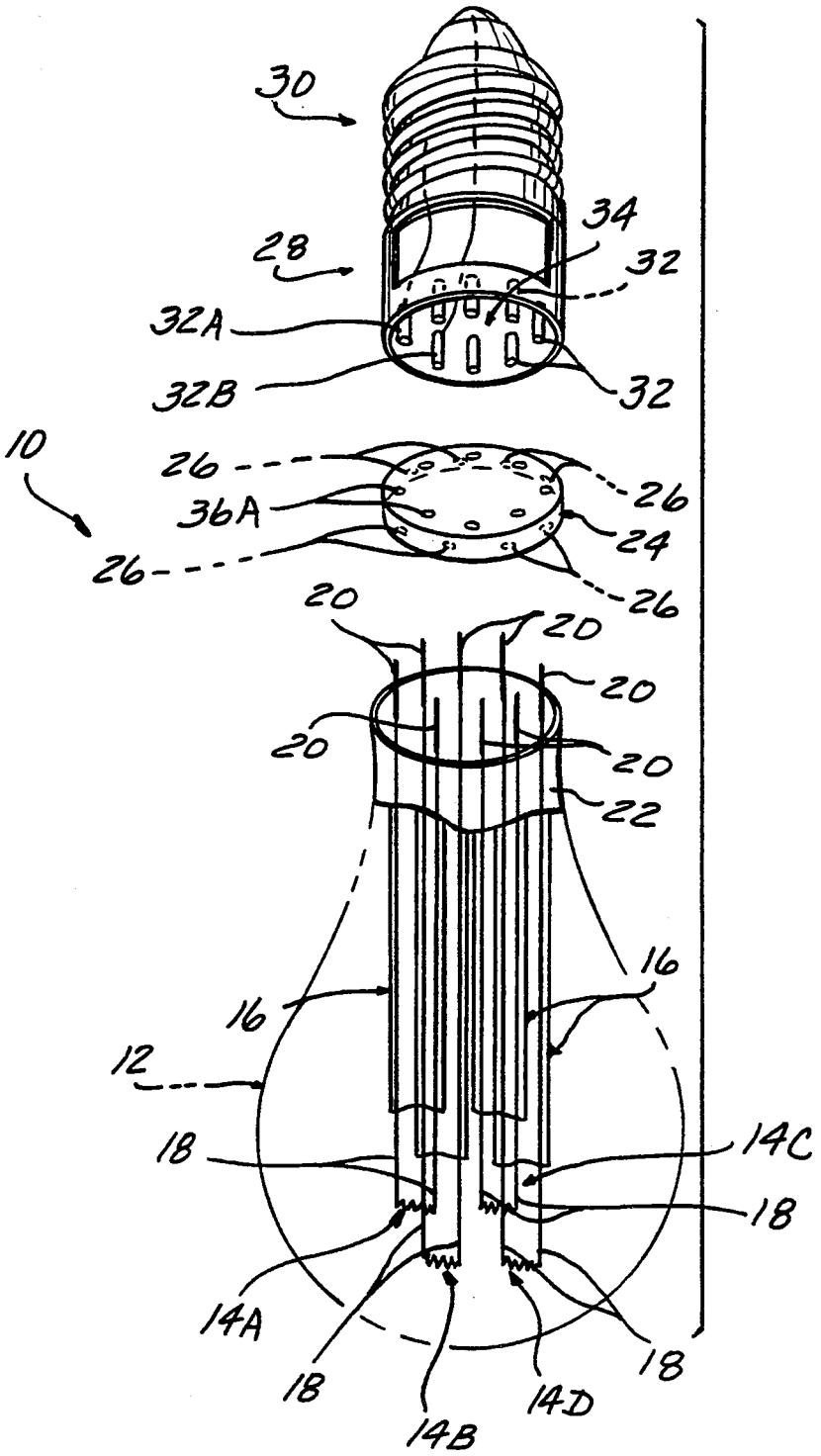
FIG. 1 is an exploded perspective view of a light bulb according to the present invention.

Referring to the drawings, FIG. 1 depicts in an exploded perspective view the various components of a light bulb 10 according to the present invention, including a glass bulb 12 having multiple filaments 14 each mounted within the hollow interior glass bulb 12 on nonconductive supports 16 by means of the projecting ends of conductive wire leads 18. Wire leads 18 extend to an array of power connector bulb pins 20 molded in an end wall 22 of the glass bulb 12 to extend axially therefrom.

A program disc 24 is formed with a series of power output sockets 26 which are arranged in a matching pattern to mate with power connector bulb pins 20. The program disc 24 is preferably constructed of a heat resistant electrically nonconducting material such as a suitable ceramic substance.

The sockets 26 are electrically conductive to establish an electrical connection with the pin 20 when inserted therein.

A base 28 is provided with a conventional socket section 30 adapted to be screwed into a conventional lamp socket.

A series of base pins 32 project axially from an end wall 34 at the end of the base 28 facing away from the socket section 30.

Two of the base pins 32A and 32B are connected to the socket section 30 so as to be energized with the electrical contact established when the base is screwed into a lamp socket and power turned on.

The program disc 24 is formed with a series of power input sockets 36 on the opposite face from the power output sockets 26, arranged in a pattern matching that of the base pins 32 so as to allow insertion therein. The input sockets 36 and output sockets 26 are nonaligned with each other so as to enable a reduction in the thickness of the program disc 24.

The program disc 24 contains internal connections between the input sockets 36 and output sockets 26 so as to create a particular desired function. In addition, other circuit elements may be incorporated in these connections, as will be described.

Figure 2:
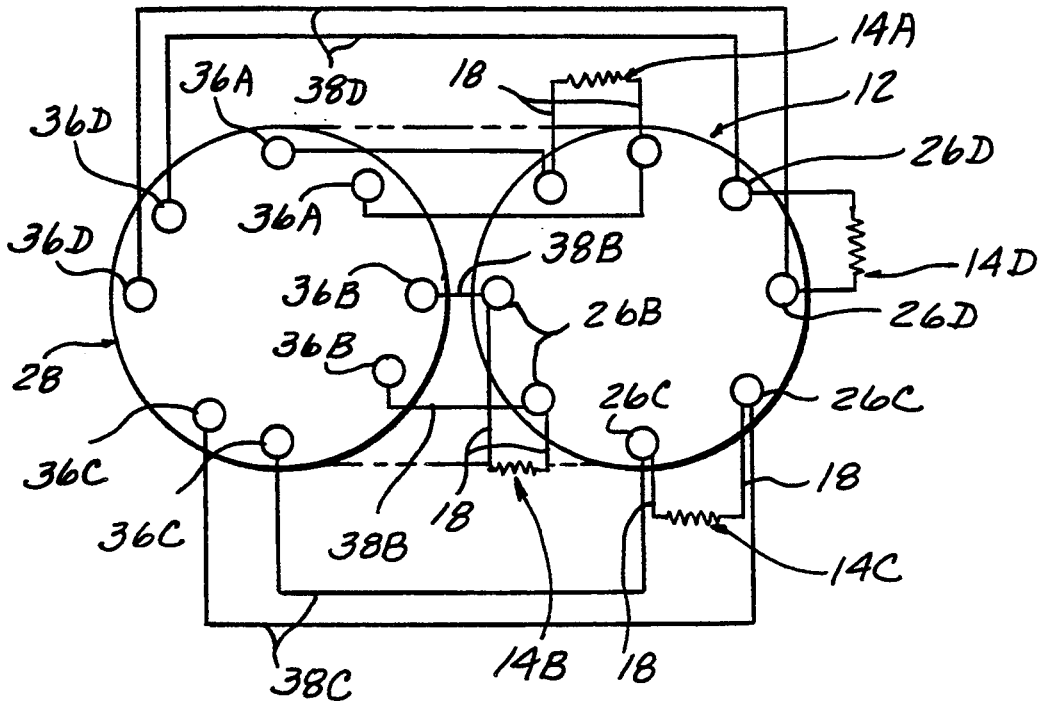
FIG. 2 is a schematic representation of the built in electrical leads of one configuration of the program disc according to the invention.
Figure 3:
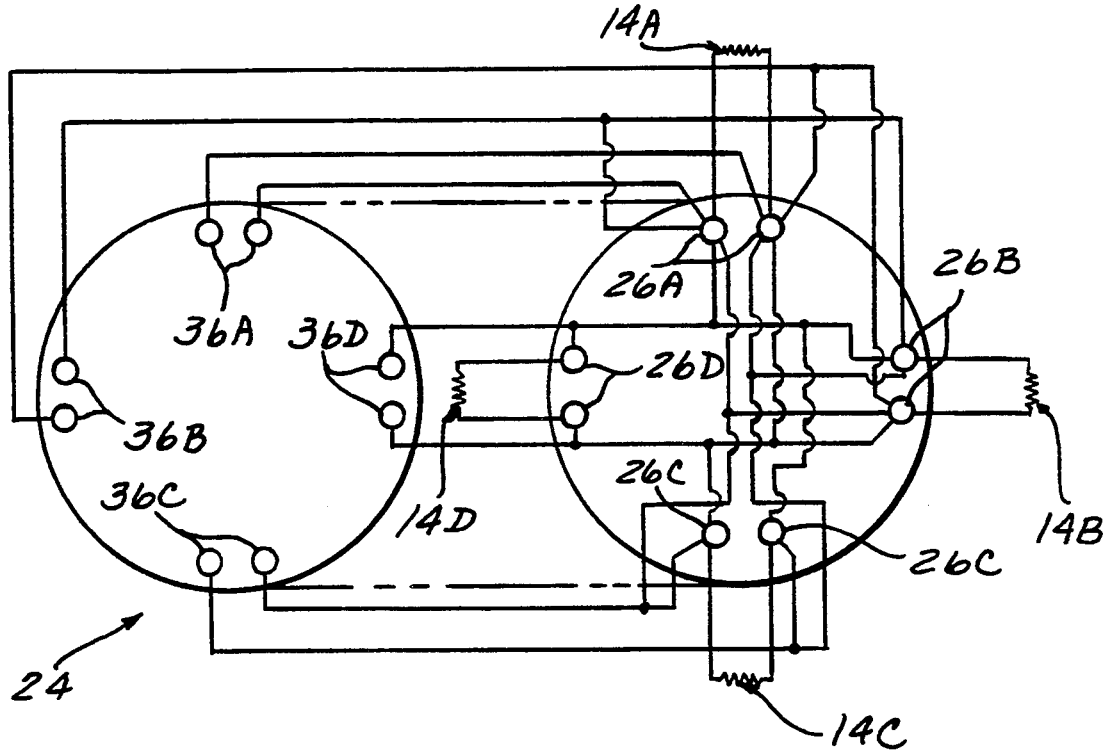
FIG. 3 is a schematic representation of the built in electrical leads of an alternative configuration of the program disc according to the invention.

FIG. 2 shows a connection arrangement which allows each filament 14A–14D to be energized individually depending on the rotated position of the base 28 on the program disc 24. The input sockets 36 are preferably arranged in a series of four adjacent pairs 36A, 36B, 36C, 36D so that the input pins 36 can only be inserted in four rotated positions, each position two sockets apart.

The output sockets 26 are arranged in pairs 26A–26D which are electrically connected to a respective filament 14A–14D with wires 18.

Each pair of input sockets 36A–36D are connected with internal connections 38A–38D to a respective pair of output sockets 26A–26D.

Thus, by installing the base 12 in respective rotated positions, each filament 14A–14D can be individually energized, as only the base pins 32A, 32B are energized, the remaining base pins 32 being merely dummies.

FIG. 3–6 illustrate an alternate arrangement for energizing combinations of filaments for varying power outputs. Input sockets 36A are connected via internal connections only to output sockets 26A, energizing filament 14A.

Input sockets 36B are connected to both output sockets 26A, 26B, energizing both filaments 14A, 14B.

Input sockets 36C are connected to output sockets 26A–26C to energize filaments 14A–14C.

Input sockets 36D are connected to all of the output sockets 26A–26D to energize all of filaments 14A–14D.

In order to isolate the internal connections, the input sockets 26B comprise two separated rings, 36A, 36B, electrically connected into the circuit only when the base pins 32A, 32B are inserted.

Figure 5:
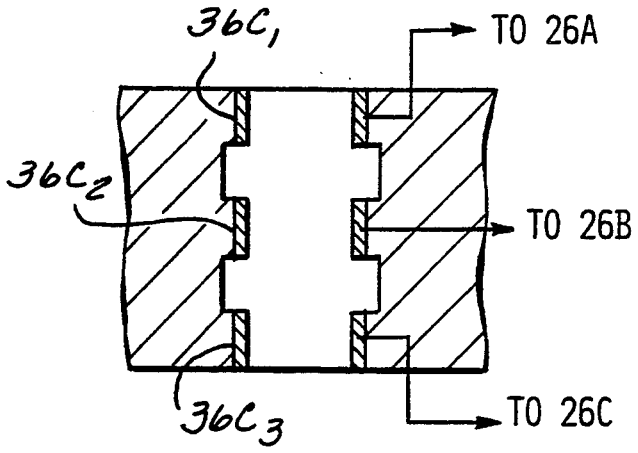
FIG. 5 is a schematic diagram of the built in electrical leads incorporated in the program disc of FIG. 3, showing the second set of socket rings included in the program disc of FIG. 3.
Figure 4:
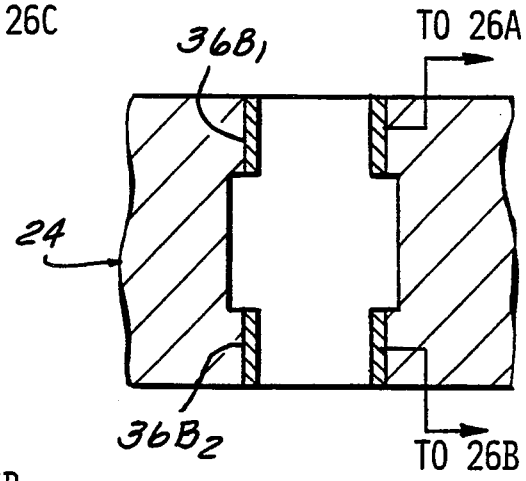
FIG. 4 is a schematic diagram of the built in electrical leads incorporated in the program disc of FIG. 3, showing the connections to a first set of pin socket rings included in the program disc of FIG. 3.

Similarly, as shown in FIG. 5, three separated socket rings $36C_1$, $36C_2$, $36C_3$ are employed, connected to 26A, 26B, and 26C respectively.

Figure 6:
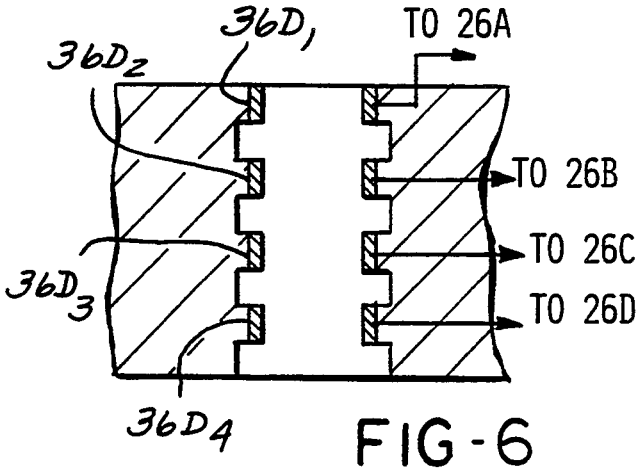
FIG. 6 is a schematic diagram of the built in electrical leads incorporated in the disc of FIG. 3, showing the third set of socket rings included in the program disc of FIG. 3.

FIG. 6 shows four input socket rings $36C_1$–$36C_4$ connected to output sockets 26A–26D respectively.

Thus, when dummy, nonconductive base pins 32 are inserted, the connected output sockets 26 are isolated from the input sockets 36, only the sockets 26 associated with the input sockets 36 having the energized pins 32A, 32B connected by the internal connections.

Figure 7:
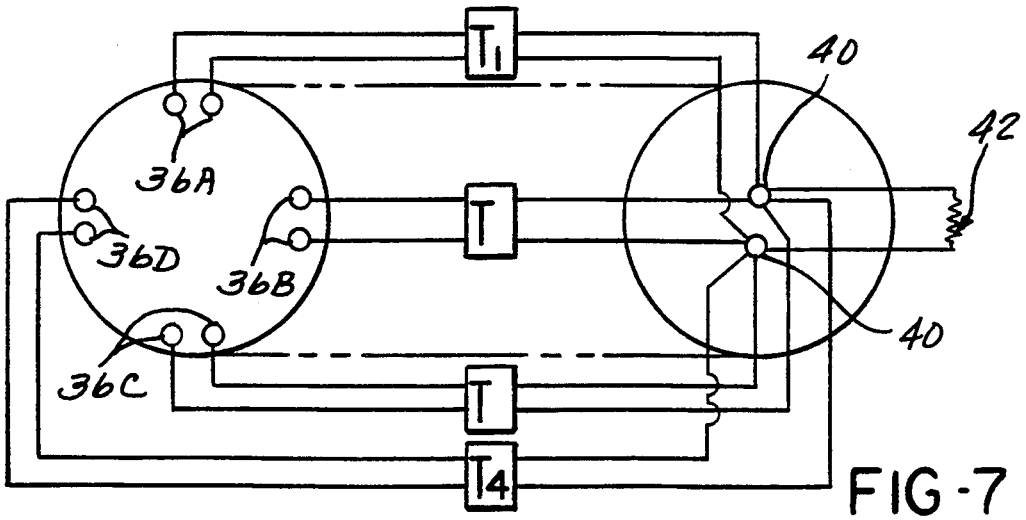
FIG. 7 is a schematic diagram of another alternative embodiment of the program disc.

FIG. 7 schematically shows another option, in which transformer components $T_1$–$T_4$ are all connected to a single output socket 40 via internal connections to a respective input socket 36A–36D. The transformers $T_1$–$T_4$ cause varying voltage levels on the bulb filament 42 to enable varying levels of power consumption and bulb brightness.

The program disc 24 can be replaced with different types to achieve different functional control modes.

The program disc is more compact and reliable than prior spring contacts and allows many more possibilities of control.

The other possible functions include remote control alarms, timers, etc., instead of pairs of leads and pin and sockets.

As will be appreciated by those skilled in the art, a common lead could be employed to reduce the number of pins, sockets, timer, alarm, etc.

I claim:

1. A light bulb comprising:

a base having a socket section configured to be received in a socket be connected to a source of electrical power, said socket section having portions establishing electrical contact with said socket;

a pair of power output contact elements on said base, said pair of power output contact elements electrically connected to respective portions of said socket section;

a bulb defining a sealed cavity and having at least one filament mounted therein, a pair of wire leads connected to said filament and extending through an endwall of said bulb;

power input contact elements extending through said bulb endwall, said power input contact elements connected to a respective one of said wire leads;

a program disc constructed of electrically insulating material interposed between said base and said bulb, said program disc having two opposite sides, each side adjacent a respective one of said base and said bulb end wall, and each side of said program disc having a separate set of contacts, each set of contacts matrable with each power output and input contact elements of said base and bulb respectively by a pin and socket connection; and interconnection means carried by said program disc electrically interconnecting each contact on said one side of said program disc with a respective contact on said other side of said program disc, said interconnection means creating a different electrical connection between said base contact elements and said bulb contact elements in different rotated positions of said program disc.

2. The light bulb of claim 1 wherein said program disc set of contacts on each side of said program disc comprise a series of circumferentially spaced contacts which are adapted to mate with said base and bulb contact elements in each of a plurality of successive rotated positions of said program disc on said base and bulb endwall.

3. The light bulb of claim 1 wherein said program disc contacts are disposed in a series of sockets and said base and bulb contact elements are comprised of axially extending pins.

4. The light bulb according to claim 3 wherein said bulb is provided with a plurality of filaments, each having a pair of electrical leads extending through said bulb end wall, and a circumferentially spaced series of pairs of power input contact elements on said bulb end, each bulb contact element pair electrically connected with a respective filament electrical lead, said program disc including a series of pairs of contact elements disposed in corresponding sets of pairs of sockets on said one side of said program disc corresponding to each of said bulb contact element pair sets located to enable mating together in said successive rotated installed positions of said program disc.

5. The light bulb according to claim 3 wherein at least some of said program disc sockets carry a plurality of separate contacts comprising axially spaced rings disposed therein, and wherein said interconnection means establishes an electrical connection between said rings and said base contact elements whereby a plurality of filaments may be connected to said base power output elements in at least one installed position of said program disc.

6. The light bulb according to claim 4 wherein several socket sets of said program disc sockets have a plurality of contact rings therein and wherein said interconnection means establishes an electrical connection of said all of said contact rings in a particular socket with a respective bulb contact element so that filaments are connected to said base power output elements in successive rotative positions of said program disc on said bulb end wall.

7. The light bulb according to claim 1 wherein said program disc contains a plurality of transformers and wherein said interconnection means connects a single transformer between said base contact elements and said bulb contact elements in each successive rotated installed position of said program disc on said base and bulb end.

8. The light bulb according to claim 3 wherein said sockets of said program disc formed on either side of said program disc are circumferentially offset from each other.

* * * * *